US007210865B2

(12) United States Patent
Abe

(10) Patent No.: US 7,210,865 B2
(45) Date of Patent: May 1, 2007

(54) AUTOMATIC DEVELOPING APPARATUS AND PROCESS FOR FORMING IMAGE USING THE SAME

(75) Inventor: Hirofumi Abe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 186 days.

(21) Appl. No.: 11/113,099

(22) Filed: Apr. 25, 2005

(65) Prior Publication Data

US 2005/0238351 A1 Oct. 27, 2005

(30) Foreign Application Priority Data

Apr. 23, 2004 (JP) ..... 2004-127548

(51) Int. Cl.
*G03D 3/08* (2006.01)

(52) U.S. Cl. ..... 396/612; 355/27; 492/28

(58) Field of Classification Search ..... 396/612
See application file for complete search history.

(56) References Cited

U.S. PATENT DOCUMENTS 3,640,203 A * 2/1972 Raab et al. ..... 396/608
5,914,224 A * 6/1999 Yamazaki et al. ..... 430/523
6,102,588 A * 8/2000 Verlinden et al. ..... 396/612
2004/0154488 A1* 8/2004 Tomita et al. ..... 101/458

FOREIGN PATENT DOCUMENTS

JP 06095335 * 4/1994
JP 11104613 * 4/1999
JP 2004033816 * 2/2004

* cited by examiner

*Primary Examiner*—D. Rutledge
(74) *Attorney, Agent, or Firm*—Sughrue Mion, PLLC

(57) ABSTRACT

A photographic light-sensitive material having a support having a thickness of from 160 to 225 μm is processed with an automatic developing apparatus, in which at least one of rollers of a developing part, a fixing part and a rinsing rack part of the automatic developing apparatus has a surface mainly containing a nonpolar polymer substance and having a center line surface roughness (Ra) of 20 μm or less. By using the automatic developing apparatus, dusts generated in the apparatus can be easily removed with a cleaning film.

10 Claims, 1 Drawing Sheet

AUTOMATIC DEVELOPING APPARATUS AND PROCESS FOR FORMING IMAGE USING THE SAME

BACKGROUND OF THE INVENTION

1. Field of the Invention

The present invention relates to an automatic developing apparatus for developing a photographic light-sensitive material, in particular, a silver halide photographic light-sensitive material for a photomask (a mask film) for industrial use, and a process for forming an image using the same.

2. Description of the Related Art

In recent years, a printed circuit board is being miniaturized according to reduction in size of home electric appliances, such as a potable phone. According to the miniaturization of a printed circuit board, the wiring pattern formed on the surface of the circuit board is being thinned. It is the current situation that the line width of the pattern formed on the printed circuit board produced by using a mask film is as thin as from 10 to 15 μm.

The mask film herein is a pattern film used for exposing a printed circuit board. The pattern film is inspected for detecting defects with an AOI (automated optical inspection) system (such as FPT-MARVEL, produced by Yachiyo Corp.). In order to inspect the pattern having a width of from 10 to 15 μm, in general, the inspection system is necessarily set to such a configuration that can detect defects having a size of about 5 μm. However, there are cases where dusts attached upon development bring about false detection, which is thus a factor inhibiting exact evaluation.

Examples of the dusts as the inhibiting factor include those floating in a developing part, a fixing part and a rinsing rack part of an automatic developing apparatus, and those attached to rollers. These dusts are formed mainly of water stain and attached silver. The water stain is formed mainly by putrefaction of gelatin eluted from a light-sensitive material film by bacteria.

In order to prevent dusts from being attached to a mask film, a developer solution, a fixing solution and water used in an automatic developing apparatus are previously cleaned by filtering with such a filter that is capable of removing dusts having a size of 3 μm or more. However, the filter cannot remove bacteria, and bacteria remaining in a developer solution or the like putrefies gelatin eluted from a film to form foreign matters having a size of 5 μm or more. Therefore, in a conventional automatic developing apparatus, gelatin is accumulated in grooves formed on the surface of the roller. Furthermore, there is also such a problem that the entire surface of the roller is putrefied to form water stain constitutively, and as a result, the surface of the developed film is contaminated thereby.

In order to remove the stain forcedly, a cleaning system using a cleaning film (for example, Fuji Cleaning Film, produced by Fuji Photo Film Co., Ltd.) has been developed. However, a conventional automatic developing apparatus generally requires about 10 sheets of cleaning films. Furthermore, in order to remove the stain completely, it is necessary to clean the rack periodically, which brings about increase in labor cost.

Upon developing a mask film, an automatic developing apparatus for ordinary prepress for printing has been conventionally used. In the case where an automatic developing apparatus for prepress for printing is used, in order to increase conveying power of rollers, the rollers used therein have grooves on the surfaces thereof for conveying light-sensitive materials using a PET base material having a thickness of from 60 μm, which has low stiffness, to a PET base material having a thickness of 175 μm, which has high stiffness.

However, the mask film mainly uses a support having a thickness exceeding 175 μm, and there is such a problem that dusts get into the grooves for improving the conveying power and are attached to the surface of the film.

JP-A-6-95335 discloses an automatic developing apparatus for carrying out developing, fixing and rinsing steps by conveying a light-sensitive material with porous conveying rollers, in which the apparatus has means for applying a processing solution to the light-sensitive material held and conveyed with the porous conveying rollers, and means for heating the processing solution applied to the light-sensitive material.

JP-A-6-95335 discloses that the automatic developing apparatus can be miniaturized and is substantially free of fatigue of the processing solution, and the developing apparatus can be easily operated and maintained.

JP-A-6-95335 discloses an automatic developing apparatus using rollers having a large number of pores on the surface thereof, but there is no description about specific surface roughness of the rollers. Furthermore, JP-A-6-95335 has no description relating to water stain, which is considered in the invention.

JP-A-11-104613 discloses a method for preventing formation of water stain in a water rinsing step after photographic development by automatically feeding a water stain preventing agent to rinsing water and automatically mixed by agitating therewith, in which the agitation is started before feeding the water stain preventing agent, and the agitation is continued beyond the completion of feed of the water preventing agent until the water stain preventing agent is completely dissolved and dispersed in rinsing water. JP-A-11-104613 discloses that the method for preventing formation of water stain can effectively and economically prevents formation of water stain in rinsing water used in the rising step after photographic development.

JP-A-2004-33816 discloses a controlling system having the following features. In the first feature, from 0.01 to 0.1 ppm of ozone gas is fed to water in a rinsing bath. In the second feature, from 0.01 to 0.1 ppm of an ozone gas is fed to the rinsing bath during a predetermined period, and after terminating the feed of ozone gas, the same feeding operation is carried out within a period of time that is five times or less the feeding time, followed by repeating the operation. In the third feature, the system is constituted by an ozone generator, a blower pump, a feed controlling timer and a feed pausing timer, and the feed controlling timer and the feed pausing timer are alternately operated to feed ozone gas intermittently with certain intervals to rinsing water or circulating water used in a processing step of various photographic films or luminescent materials or printing processes. In the fourth feature, the controlling system delays the operation time of the blowing pump for feeding ozone gas after completing the feed of ozone gas in such a period that corresponds to the capacity of piping from the apparatus to the rinsing bath. JP-A-2004-33816 discloses that formation of water stain in photographic films and light-sensitive materials for prepress can be prevented with ozone gas by using the controlling system without adverse affect on photographic films and light-sensitive materials for prepress in a convenient manner suitable for the target matters, e.g., the rinsing bath capacity, and the photographic films and light-sensitive materials for prepress.

However, JP-A-11-104613 and JP-A-2004-33816 relate to prevention of formation of water stain but cannot deal with water stain having been formed, and also cannot deal with invading foreign matters. Therefore, these literatures fail to provide an ultimate solution to the outstanding problem.

In particular, rollers in a conventional automatic developing apparatus have conveying grooves, and there has been no solution to the problem that water stain is liable to be attached to the grooves.

SUMMARY OF THE INVENTION

An object of the invention is to solve the aforementioned problems associated with the conventional techniques, and in order to prevent dusts floating in a developing part, a fixing part and a rinsing rack part from being attached to rollers to contaminate films, to provide such an automatic developing apparatus that can conveniently remove dusts with a cleaning film.

The inventors have analyzed mechanisms of attaching water stain and foreign matters to the surface and the grooves of the rollers of an automatic developing apparatus, and have found that water stain gets into recessions on the surface of the rollers and is transferred to the films.

In the automatic developing apparatus of this kind, the dusts attached to the rollers are mainly gelatin deposited from a film (a light-sensitive material). Gelatin has high adhesion property, and upon once attaching to the roller, it cannot be easily removed and contaminates the surface of the film. In the invention, therefore, the smoothness of the material of the rollers is improved to remove grooves, to which gelatin is attached.

As a result of earnest investigations made by the inventors, it has been found that the adhesion property of the roller can be improved by making the surface roughness of the roller be 20 μm or less, and using a nonpolar material on the surface of the roller. Specifically, the invention relates to the following embodiments.

(1) The automatic developing apparatus of the invention is for processing a photographic light-sensitive material having a support having a thickness of from 160 to 225 μm, the automatic developing apparatus contains a developing part, a fixing part and a rinsing rack part, the developing part, the fixing part and the rinsing rack part each has a roller for conveying the light-sensitive material, and at least one of the rollers of the developing part, the fixing part and the rinsing rack part has a surface mainly containing a nonpolar polymer substance and having a center line surface roughness (Ra) of 20 μm or less.

(2) It is preferred in the automatic developing apparatus as described in the item (1), wherein at least one of the rollers of the rinsing rack part has a surface mainly containing a nonpolar polymer substance and having a center line surface roughness (Ra) of 20 μm or less.

(3) It is preferred in the automatic developing apparatus as described in the item (1), wherein all the rollers of the developing part, the fixing part and the rinsing rack part have a surface mainly containing a nonpolar polymer substance and having a center line surface roughness (Ra) of 20 μm or less.

(4) It is preferred in the automatic developing apparatus as described in one of the items (1) to (3), wherein the roller having a surface mainly containing a nonpolar polymer substance and having a center line surface roughness (Ra) of 20 μm or less has no groove for conveying.

(5) It is preferred in the automatic developing apparatus as described in one of the items (1) to (4), wherein the nonpolar polymer substance is a fluorine resin, a polyethylene resin, a polypropylene resin, a vinylidene fluoride resin or a polycarbonate resin.

(6) It is preferred in the automatic developing apparatus as described in one of the items (1) to (4), wherein the nonpolar polymer substance is a tetrafluoroethylene resin.

(7) The process for forming an image of the invention contains a step of processing a photographic light-sensitive material having a support having a thickness of from 160 to 225 μm with an automatic developing apparatus containing a developing part, a fixing part and a rinsing rack part each having a roller for conveying the light-sensitive material, and at least one of the rollers of the developing part, the fixing part and the rinsing rack part has a surface mainly containing a nonpolar polymer substance and having a center line surface roughness (Ra) of 20 μm or less.

(8) It is preferred in the process for forming an image as described in the item (7), wherein the photographic light-sensitive material has an emulsion surface containing a matte material having an average particle diameter of 10 μm or less.

(9) It is preferred in the process for forming an image as described in the item (7) or (8), wherein the photographic light-sensitive material has no gelatin layer on a surface opposite to an emulsion surface.

(10) It is preferred in the process for forming an image as described in one of the items (7) to (9), wherein the photographic light-sensitive material has a gradation sequence of 10 or more.

By using the automatic developing apparatus of the invention, dusts generated in the developing part, the fixing part and the rinsing rack part are hardly attached to the rollers, or even when the dusts are attached thereto, they can be easily removed in a short period of time. Furthermore, no problem arises in conveying property without grooves on the rollers.

Consequently, the surface of the mask film or the like can be prevented from being contaminated, and the load of cleaning the automatic developing apparatus and the cleaning process can be reduced, In the case where an AOI system is employed, false detection can be significantly reduced to enable exact evaluation of a printed circuit board with a thin wiring pattern.

BRIEF DESCRIPTION OF THE DRAWINGS

In FIG. 1, numeral 1 denotes a developing part, 2 denotes a fixing part, 3 denotes a rinsing rack part, 4 denotes a film, 5 denotes a film entry part, 6 denotes a squeezing part, 7 denotes a drying part, 8 denotes a bright room film entry part, 9 denotes a rinsing reentry part, 10 denotes a film sensor, and 11 denotes a film tray.

BEST MODE FOR CARRYING OUT THE INVENTION

Figure 1:
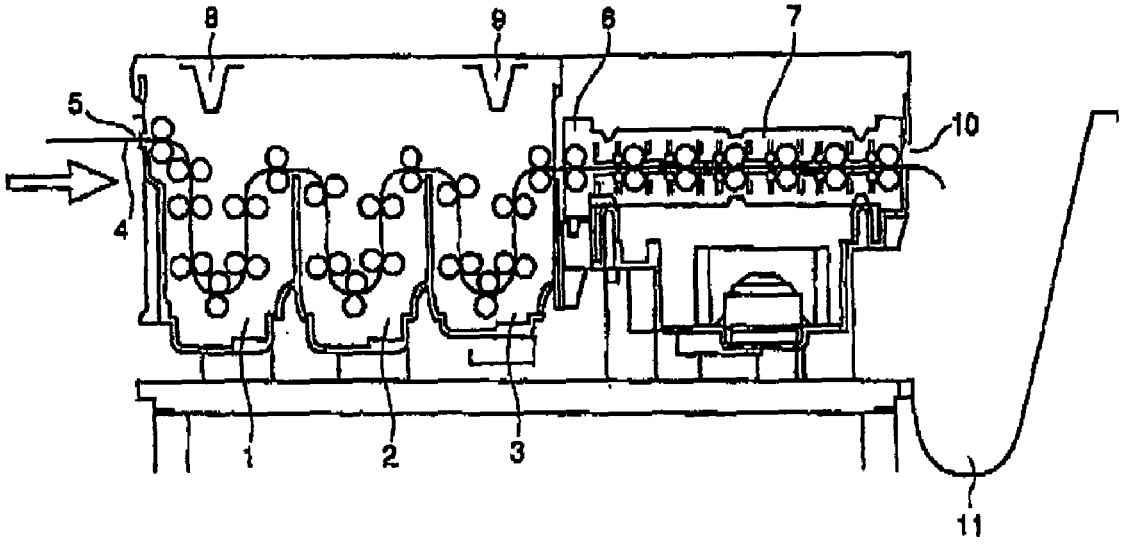
FIG. 1 is a schematic constitutional view showing an example of an automatic developing apparatus according to the invention.

The invention will be described in detail below.

FIG. 1 is a schematic constitutional view showing an example of an automatic developing apparatus according to the invention, in which numeral 1 denotes a developing part, 2 denotes a fixing part, and 3 denotes a rinsing rack part. A film 4 enters the apparatus through a film entry part 5 and reaches a squeezing part 6 and a drying part 7 through the developing part 1, the fixing part 2 and the rinsing rack part 3 in this order. The automatic developing apparatus of the invention has the developing part, the fixing part and the rinsing rack part, in which at least one of the rollers of the developing part, the fixing part and the rinsing rack part has, preferably all the rollers thereof have, a surface mainly containing a nonpolar polymer substance and having a center line surface roughness (Ra) of 20 μm or less (hereinafter, sometimes referred to as a roller of the invention).

According to the constitution, dusts formed in the developing part, the fixing part and the rinsing rack part are prevented from being attached to the film, and even when the dusts are attached thereto, they can be easily removed in a short period of time.

The automatic developing apparatus of the invention may have a bright room film entry part 8, a rinsing reentry part 9, a film sensor 10 and a film tray 11, as shown in FIG. 1.

The automatic developing apparatus of the invention may not necessarily satisfy all the constitutions shown in the embodiment, and may have another constitution not shown in the embodiment.

The rollers provided in the developing part, the fixing part and the rinsing rack part are preferably arranged in such a manner that the profile of the film to be conveyed is in U-formation, V-formation, W-formation or wave formation for uniformly spreading a developing solution, a fixing solution or water over the surface of the film, and among these, U-formation is preferred.

In FIG. 1, the large arrow at the left end shows the conveying direction of the film thus entering.

In the case where the roller of the invention is used only a part of the rollers provided in the developing part, the fixing part and the rinsing rack part, the roller of the invention is preferably used as the rollers in contact with the emulsion surface. In the case where the roller of the invention is used in one of the developing part, the fixing part and the rinsing rack part, the roller of the invention is preferably provided in the rinsing rack part.

The number of the rollers provided in the developing part, the fixing part and the rinsing rack part may be appropriately determined depending on purposes, and in the case where a mask film is processed, the number is preferably from 10 to 16.

The roller of the invention may be used only one of pair of rollers facing each other, and a conventional roller may be used the other of the pair.

The diameter of the roller may be appropriately determined depending on such conditions as the size of the film to be developed, and in the case where a mask film is processed, for example, the diameter is preferably from 20 to 40 mm. Pair of rollers facing each other may have the same diameters or different diameters. In the case where the rollers are arranged in such a manner that the profile of the film is in U-formation, it is preferred that the roller provided inside the film (particularly at the corner part) has a smaller diameter than the roller provided outside the film. The roller outside the film at the corner part may be omitted.

The rollers of the developing part may be provided alternately on the front side and the back side of the film for spreading a developing solution to both the front and back surfaces of the film.

The developing solution used in the developing part may be selected from wide variations of known products depending on purposes and kinds of the light-sensitive material to be developed, and in the case where a mask film is processed, for example, a developer solution ND-1 (produced by Fuji Photo Film Co., Ltd.) is preferably used.

The fixing solution used in the fixing part may be selected from wide variations of known products depending on purposes and kinds of the light-sensitive material to be developed, and in the case where a mask film is processed, for example, fixing solutions NF-1 and SR-F1 (produced by Fuji Photo Film Co., Ltd.) are preferably used.

The drying part 7 may have rollers for conveying the film 4, and in this case, the rollers are preferably arranged in a staggered form in the vertical direction. A hot air feeding part for blowing hot air on the both surfaces of the film 4 in the drying part is preferably provided, and plural numbers of the hot air feeding parts are preferably provided on both sides of the conveying path of the film 4. It is also preferred that the film is dried by moderate hot air drying after transferring from the constant rate drying area (in which the heat applied to the film having water on the surface thereof is used as the evaporation latent heat) to the reduced rate drying are (in which water on the surface of the film is evaporated to reduce the amount thereof). The film 4 having passed the drying part is conveyed with the rollers and housed in the film tray 11.

In the automatic developing apparatus of the invention, at least one of the rollers of the developing part, the fixing part and the rinsing rack part has, preferably all the rollers thereof have, a surface mainly containing a nonpolar polymer substance. Therefore, the material constituting the roller of the invention is not particularly limited as far as the surface thereof mainly contains a nonpolar polymer substance. The nonpolar polymer substance herein is, for example, a polymer substance having no permanent dipole, but may contain such permanent dipoles derived from impurities in an ordinary amount, and an additive and a stabilizer that are generally added owing to the technical necessity.

The material of the surface of the roller is preferably a fluorine resin, such as a tetrafluoroethylene resin, e.g., Teflon (a trade name, produced by Du Pont, Inc.), a polyethylene resin (PE), a polypropylene resin (PP), a polyvinylidene fluoride resin and a polycarbonate resin (PC), and more preferably a tetrafluoroethylene resin, e.g., Teflon (a trade name), a polyethylene resin (PE) and a polypropylene resin (PP). In particular, the roller used in the developing part preferably has a surface formed with a polytetrafluoroethylene resin (particularly, Teflon), the roller used in the fixing part preferably has a surface formed with a polytetrafluoroethylene resin (particularly, Teflon), and the roller used in the rinsing rack part preferably has a surface formed with a polytetrafluoroethylene resin (particularly, Teflon). The resin may be a film attached to the surface of the roller or may be coated on the surface of the roller.

The roller has a surface having a center line surface roughness (Ra) of 20 μm or less, preferably from 3 to 15 μm, and more preferably from 3 to 10 μm.

The center line surface roughness (Ra) in the invention is measured based on 5 μm.

By using the roller of the invention, an adhesive material, such as gelatin, is hardly attached to the surface of the roller. Furthermore, dusts can be easily removed by using several cleaning films.

In the automatic developing apparatus of the invention, formation of water stain may be prevented by adding a water stain preventing agent or by feeding ozone gas. The water stain preventing agent is not particularly limited as far as it impairs the gist of the invention, and examples thereof include creosote, an isothiazolone compound, a halogenated aliphatic nitroalcohol and an aminocarboxylic acid. The water stain preventing agent may be used solely or in combination of two or more of them.

The photographic light-sensitive material used in the automatic developing apparatus of the invention may be selected from wide variations of known products having a support having a thickness of from 160 to 225 μm (preferably from 178 to 180 μm). By using the photographic light-sensitive material having a thickness within the range, the problem on conveying the conventional material can be avoided even though no groove is provided on the surface of the roller. The material for the support may be polyester (preferably polyethylene terephthalate (PET), whereby the conveying property can be further improved.

More specifically, examples of the photographic light-sensitive material used in the automatic developing apparatus of the invention include such a silver halide photographic light-sensitive material having a support and at least one layer of a silver halide emulsion surface. Furthermore, the light-sensitive material preferably has an emulsion surface on one surface of the support, and an electroconductive surface or a back surface on the surface opposite to the emulsion surface. The emulsion surface of the material preferably has an UL layer, an emulsion layer and a protective layer in this order from the side near the support.

The photographic light-sensitive material preferably contains a matte material, and more preferably has an emulsion surface containing a matte material. A matte material may also be contained on the surface opposite to the emulsion surface.

The matte material preferably has an average particle diameter of 10 μm or less, more preferably from 1 to 10 μm, further preferably from 1 to 9 μm, and most preferably from 1 to 5 μm.

The content of the matte material is preferably 25 mg/m$^2$. Examples of the material for the matte material include fine particle silica and polymethyl methacrylate (PMMA).

Examples of the other layers provided in the photographic light-sensitive material of the invention include a binder layer. As the binder, gelatin, a polymer resin and a cellulose compound are preferably used, with gelatin being more preferred.

It is preferred that the side opposite to the emulsion surface contains no gelatin layer. The light-sensitive material having the constitution is preferred since water stain is hardly attached to the film.

The photographic light-sensitive material used in the automatic developing apparatus of the invention preferably has a gradation sequence of 10 or more. The gradation sequence herein means a value measured according to the method described in paragraphs 0173 to 0175 of JP-A-2003-280128. The light-sensitive material having the constitution is preferred since good image quality can be obtained, and dusts are hardly attached thereto.

As the photographic light-sensitive material used in the automatic developing apparatus of the invention, those described in JP-A-2003-280143 and JP-A-2003-208128 are preferably used.

The automatic developing apparatus of the invention can be preferably used for a silver halide photographic light-sensitive material for a photomask.

Water stain can be easily removed in the automatic developing apparatus of the invention by using a cleaning film. As the cleaning film, those capable of removing water stain in the automatic developing apparatus of the invention can be appropriately selected.

A light-sensitive material having gelatin coated on a PET film to a thickness of 3 μm or less can be preferably used.

EXAMPLE

The invention will be described in more detail with reference to the following examples. The materials, the using amounts, the ratios, the processes and the order of processes can be appropriately changed unless they deviate from the gist of the invention. Therefore, the invention is not limited to the following examples.

Example 1

Determination of Number of False Detection with AOI System

All rollers (12 rollers) provided in a developing part, a fixing part and a rinsing rack part of a commercially available automatic developing apparatus (FG710FK, produced by Fuji Photo Film Co., Ltd.) were removed, and rollers formed of Teflon (produced by Du Pont, Inc.) having a surface roughness (Ra) of 18 μm were installed.

The resulting automatic developing apparatus was measured for the number of false detection with an AOI system (FPT-MARVEL, produced by Yachiyo Corp.) by using a cleaning film (produced by Fuji Photo Film Co., Ltd.) and a light-sensitive material (NIP-R175S (EM No. 673-001), produced by Fuji Photo Film Co., Ltd.; size in the evaluation: 50.8 cm×61 cm). Defects having a size of 5 μm or more were counted.

The evaluation was carried out with a defect setting of 5 μm.

Comparative Example

A commercially available automatic developing apparatus (FG710FK, produced by Fuji Photo Film Co., Ltd.) (rollers were not changed) was measured for the number of false detection in the same manner as in Example 1.

The results of Example 1 and Comparative Example are shown in Table 1 below.

TABLE 1

| Number of cleaning films | Conventional automatic developing apparatus (Comparative Example) | Modified automatic developing apparatus (Example) |
|---|---|---|
| 1 | 450 | 300 |
| 2 | 400 | 100 |
| 5 | 300 | 50 |
| 10 | 200 | 50 |

As shown in Table 1, the number of false detection was significantly decreased in the case where the automatic developing apparatus of the invention was used, as compared to the case where the conventional automatic developing apparatus was used. Particularly, in the case where the number of cleaning sheets was 2, the accuracy was improved in four times, and in the case where the number of cleaning sheets was 5, the accuracy was improved in six times.

The automatic developing apparatus of the invention had no problem in conveying property even though no groove was provided.

Example 2

The same procedures as in Example 1 were carried out except that the light-sensitive material (NIP-R175S (EM No.

673-001)) was replaced by the materials (Samples 1 to 8) produced in the following manner.

Production of Light-Sensitive Materials

Preparation of Emulsion A

An emulsion A was prepared for producing a silver halide photographic light-sensitive material in this example.

| Liquid 1 | |
|---|---|
| Water | 650 mL |
| Gelatin | 20 g |
| Sodium chloride | 3 g |
| 1,3-Dimethylimidazolidine-2-thione | 20 mg |
| Sodium benzenethiosulfonate | 10 mg |
| Citric acid | 0.7 g |

| Liquid 2 | |
|---|---|
| Water | 300 mL |
| Silver nitrate | 150 g |

| Liquid 3 | |
|---|---|
| Water | 300 mL |
| Sodium chloride | 21 g |
| Potassium bromide | 58 g |
| $(NH_4)_3(RhCl_5(H_2O))$ (0.001% in 20% NaCl aqueous solution) | 15 mL |

$(NH_4)_3(RhCl_5(H_2O))$ (0.001%) used for preparing the liquid 3 was prepared by dissolving powder of $(NH_4)_3(RhCl_5(H_2O))$ in a 20% KCl aqueous solution followed by heating at 40° C. for 120 minutes.

67% portions of each of the liquid 2 and the liquid 3 were added to the liquid 1 maintained at 38° C. and pH 4.5 under stirring over 20 minutes to form nuclear particles having a diameter of 0.18 μm. Subsequently, a liquid 4 and a liquid 5 shown below were added thereto over 8 minutes, and then the remaining 33% portions of each of the liquid 2 and the liquid 3 were added thereto over 2 minutes to grow the particles to 0.20 μm. 0.15 g of potassium iodide was then added thereto, and the particles were aged for 5 minutes to complete the formation of particles.

| Liquid 4 | |
|---|---|
| Water | 100 mL |
| Silver nitrate | 50 g |

| Liquid 5 | |
|---|---|
| Water | 100 mL |
| Sodium chloride | 8.6 g |
| Potassium bromide | 19.2 g |
| $K_4(Fe(CN)_6).3H_2O$ (yellow prussiate of potash) | 20 mg |

Thereafter, the particles were rinsed by the ordinary flocculation method. Specifically, after decreasing the temperature to 35° C., 3 g of an anionic flocculating agent 1 shown below was added, and the pH was reduced with sulfuric acid until silver halide was flocculated (which was in a range of pH 3.2 ±0.2). About 2 L of the supernatant was removed (first rinsing). 2 L of distilled water was added, and then sulfuric acid was added until silver halide was flocculated. 2 L of the supernatant was again removed (second rinsing). The same operation as the second rinsing was repeated once (third rinsing) to complete the rinsing and desalting step. 45 g of gelatin was added to the emulsion after completing the rinsing and desalting step, which was adjusted to pH 5.6 and pAg 7.5. 10 mg of sodium benzenethiosulfonate, 3 mg of sodium benzenethiosulfinate, 6.0 mg of sodium thiosulfate pentahydrate and 4.0 mg of chlorauric acid were added to effect chemical sensitization at 55° C. to obtain optimum sensitivity, and then 100 mg of 4-hydroxy-6-methyl-1,3,3a,7-tetrazaindene as a stabilizer and 100 mg of an antiseptic (Proxel, produced by ICI Japan Ltd.) were added.

Finally, a silver iodochlorbromide cubic particle emulsion containing 55% by mol of silver bromide and 0.08% by mol of silver iodide and having an average particle diameter of 0.21 μm with a variation coefficient of 9% was obtained. The emulsion finally had pH 5.7, pAg 7.5, an electroconductivity of 40 μS/m, a density of from $1.2\times10^3$ to $1.25\times10^3$ kg/m$^3$ and a viscosity of 50 mPa·s. The internal molar amount of silver containing a metallic complex was 92.5% based on the total silver amount.

Anionic Flocculating Agent 1

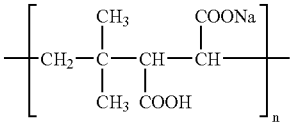

Average molecular weight: 120,000

Preparation of Silver Halide Photographic Light-Sensitive Materials 1 to 8

Preparation of Coating Compositions

The silver halide photographic light-sensitive material prepared in this example has such a structure that an UL layer, an emulsion layer, a lower protective layer and an upper protective layer were formed on one surface of a biaxially stretched polyethylene terephthalate film support having underlayers on both surfaces thereof, and an electroconductive layer and a back layer were formed on the other surface thereof.

The formulations of the coating compositions for forming the layers are shown below.

| UL Layer Coating Composition | |
|---|---|
| Gelatin | 0.8 g/m$^2$ |
| Polyethyl acrylate latex | 260 mg/g$^2$ |
| Compound (Cpd-7) | 40 mg/g$^2$ |
| Compound (Cpd-14) | 10 mg/g$^2$ |
| 5-Methylbenzotriazole | 20 mg/g$^2$ |
| Antiseptic (Proxel, produced by ICI Japan Ltd.) | 1.5 mg/g$^2$ |

| Emulsion Layer Coating Composition | |
|---|---|
| Gelatin | 1.2 $g/m^2$ |
| Ag | 2.9 $g/m^2$ |
| Spectral sensitizing dye (III-3) | $5.7 \times 10^{-4}$ mol/Agmol |
| KBr | $3.4 \times 10^{-4}$ mol/Agmol |
| Compound (Cpd-1) | $2.0 \times 10^{-4}$ mol/Agmol |
| Compound (Cpd-2) | $2.0 \times 10^{-4}$ mol/Agmol |
| Compound (Cpd-3) | $8.0 \times 10^{-4}$ mol/Agmol |
| 4-Hydroxy-6-methyl-1,3,3a,7-tetrazaindene | $1.2 \times 10^{-4}$ mol/Agmol |
| Hydroquinone | $1.2 \times 10^{-2}$ mol/Agmol |
| Citric acid | $3.0 \times 10^{-4}$ mol/Ag mol |
| 5-Methylbenzotriazole | 20 $mg/m^2$ |
| Hydrazine compound (Cpd-4) | $7.0 \times 10^{-4}$ mol/Ag mol |
| Nucleation accelerator (Cpd-5) | $1.0 \times 10^{-4}$ mol/Ag mol |

-continued

| Emulsion Layer Coating Composition | |
|---|---|
| 2,4-Dichloro-6-hydroxy-1,3,5-triazine sodium salt | 90 $mg/m^2$ |
| Aqueous latex (Cpd-6) | 100 $mg/m^2$ |
| Polyethyl acrylate latex | 150 $mg/m^2$ |
| Colloidal silica (particle size: 10 μm) | 15% by mass based on gelatin |
| Compound (Cpd-7) | 4% by mass based on gelatin |
| Latex copolymer of methyl acrylate, sodium 2-acrylamide-2-methylpropanesulfonate, and 2-acetoxyethyl methacrylate (mass ratio: 88/5/7) | 150 $mg/m^2$ |
| Core/shell latex (core: styrene-butadiene copolymer (mass ratio: 37/63), shell: styrene-2-acetoxyethyl acrylate copolymer (mass ratio: 84/16), core/shell ratio: 50/50) pH adjusted to 5.6 with citric acid | 150 $mg/m^2$ |

Cpd-1

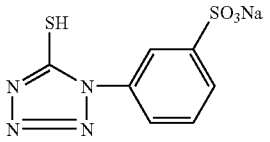

Cpd-2

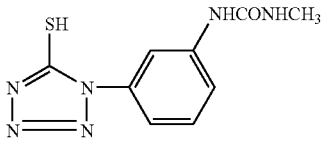

Cpd-3

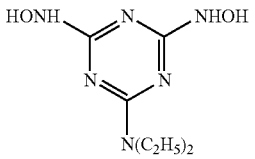

-continued

Cpd-4

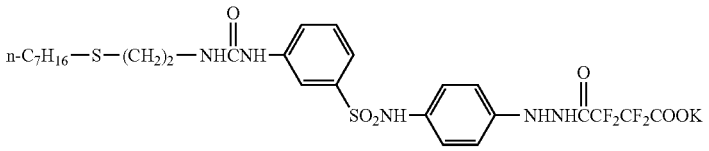

Cpd-5

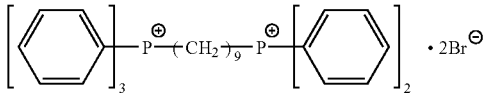

Cpd-6

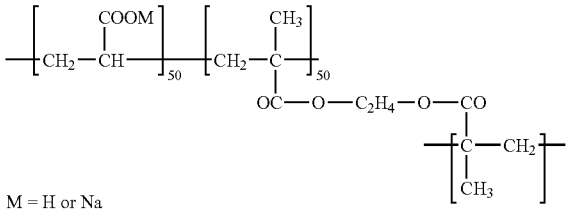

M = H or Na

Cpd-7

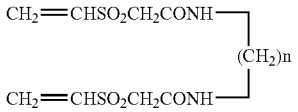

(n = 2):(n = 3) = 3:1

| Lower Protective Layer Coating Composition | |
|---|---|
| Gelatin | 0.7 g/m$^2$ |
| Compound (Cpd-12) | 15 mg/m$^2$ |
| 1,5-dihydroxy-2-benzaldoxime | 10 mg/m$^2$ |
| Polyethyl acrylate latex | 300 mg/m$^2$ |
| Colloidal silica | 300 mg/m$^2$ |
| (particle size: 10 to 20 μm, Snowtex C, produced by Nissan Chemical Industries, Ltd.) | |
| Compound (Cpd-13) | 3 mg/m$^2$ |
| Compound (Cpd-20) | 5 mg/m$^2$ |
| Antiseptic | 1.5 mg/g$^2$ |
| (Proxel, produced by ICI Japan Ltd.) | |

| Upper Protective Layer Coating Composition | |
|---|---|
| Gelatin | 0.3 g/m$^2$ |
| Matte agent | 25 mg/m$^2$ |
| (amorphous barium strontium sulfate, average particle diameter: 1.5 μm) | |
| Compound (Cpd-8) (gelatin dispersion) | 20 mg/m$^2$ |
| Colloidal silica | 30 mg/m$^2$ |
| (particle size: 10 to 20 μm, Snowtex C, produced by Nissan Chemical Industries, Ltd.) | |
| Compound (Cpd-9) | 50 mg/m$^2$ |
| Sodium dodecylbenzenesulfonate | 20 mg/m$^2$ |
| Compound (Cpd-10) | 20 mg/m$^2$ |
| Compound (Cpd-11) | 20 mg/m$^2$ |
| Antiseptic | 1 mg/g$^2$ |
| (Proxel, produced by ICI Japan Ltd.) | |

The thickening agent Z shown below was added to the coating compositions for the layers to adjust the viscosity thereof.

Cpd-8
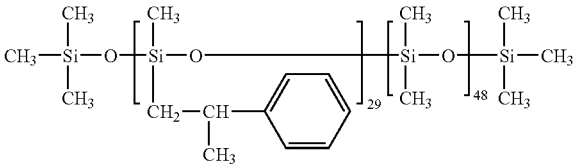
Cpd-9
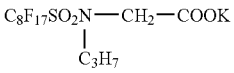
Cpd-10
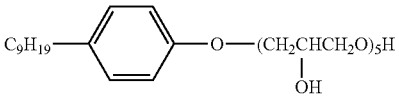
Cpd-11
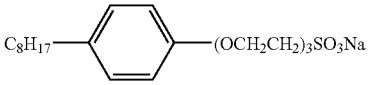
Cpd-12
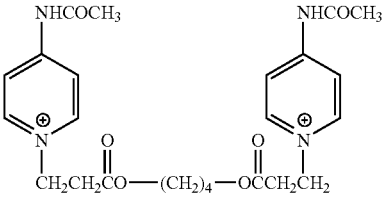
Cpd-13
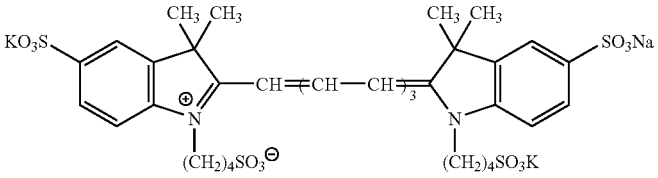
Cpd-14
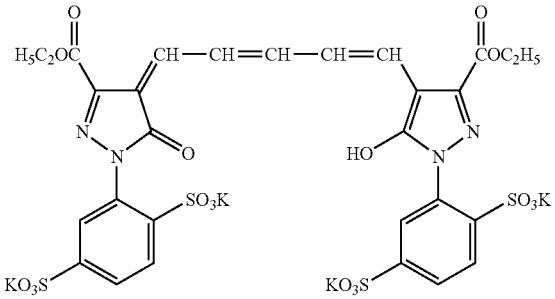
Thickening Agent Z
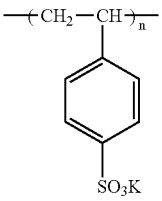
Back Layer Coating Composition
| | |
|---|---|
| Gelatin | 3.8 g/m$^2$ |

-continued

| | |
|---|---|
| Compound (Cpd-15) | 40 mg/m$^2$ |
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |
| 1,3-Divinylsulfonyl-2-propanol | 60 mg/m$^2$ |
| Polymethyl methacrylate fine particles (average particle size: 6.5 μm) | 3 mg/m$^2$ |
| Liquid paraffin | 78 mg/m$^2$ |
| Compound (Cpd-7) | 120 mg/m$^2$ |
| Compound (Cpd-20) | 5 mg/m$^2$ |
| Colloidal silica 15% by mass based on gelatin (particle size: 10 μm) | |
| Calcium nitrate | 20 mg/m$^2$ |
| Antiseptic (Proxel, produced by ICI Japan Ltd.) | 12 mg/g$^2$ |

| Electroconductive Layer Coating Composition | |
|---|---|
| Gelatin | 0.1 g/m$^2$ |
| Sodium dodecylbenzenesulfonate | 20 mg/m$^2$ |
| $SnO_2$/Sb (mass ratio: 9/1, average particle size: 0.25 μm) | 200 mg/m$^2$ |
| Antiseptic (Proxel, produced by XCI Japan Ltd.) | 0.3 mg/g$^2$ |

Cpd-15

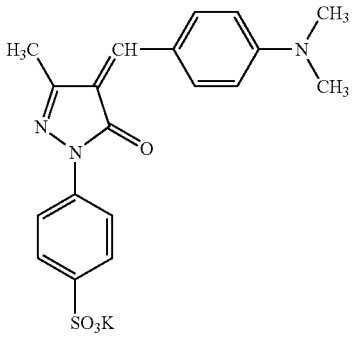

Cpd-16

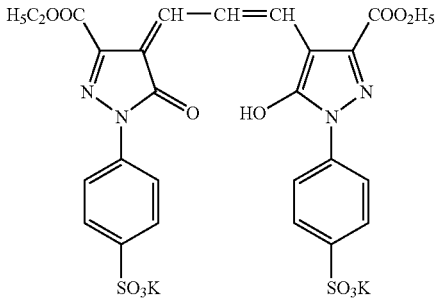

Cpd-17

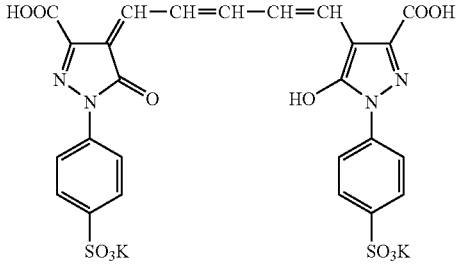

-continued

Cpd-18

$CH_3(CH_2)_{11}CH{=}CHSO_3Na$

Cpd-19

$CH_3(CH_2)_{11}CH{-}CH_2SO_3Na$

Cpd-20

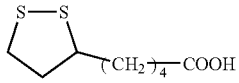

Coating Method on Support

On the outer surface of a biaxially stretched polyethylene terephthalate support (thickness: 175 μm) having coated with underlayers on both surfaces thereof and having been wound in a roll form, four layers, i.e., an UL layer, an emulsion layer, a lower protective layer and an upper protective layer, were coated as the emulsion surface side in this order from the side near the support by the simultaneous multilayer coating method with a slide bead coater system while maintaining at 35° C. under addition of a hardener solution, and the coated compositions thus coated were subjected to a cold blowing setting zone (5° C.). Thereafter, on the inner surface of the support having been wound in a roll form opposite to the emulsion surface, an electroconductive layer and a back layer were coated in this order from the side near the support by the simultaneous multilayer coating method with a curtain coater system under addition of a hardener solution, and the coated compositions thus coated were subjected to a cold blowing setting zone (5° C.). After subjecting to the setting zones, the coated compositions exhibited sufficient setting property. Subsequently, both the surfaces of the support were simultaneously dried in a drying zone under the following drying conditions. After coating the back surface side, the coated surfaces were not in contact with any member, such as a roller, until the final winding operation. The coating speed herein was 200 m/min.

Drying Conditions

After setting, the coated compositions were dried with dry air at 30° C. until the mass ratio of water/gelatin reached 800%, and dried with dry air at 35° C. and a relative humidity of 30% when the ratio was from 800% to 200%. The air was blown thereon until the surface temperature reached 34° C. (which was assumed to be completion of drying), and after lapsing further 30 seconds, the coated compositions were further dried with air at 48° C. and a relative humidity of 2% for 1 minute. The drying time from the start of drying to a water/gelatin ratio of 800% was 50 seconds, the drying time from 800% to 200% was 35 seconds, and the drying time from 200% to the completion of drying was 5 seconds.

According to the automatic developing apparatus of the invention, dusts are hardly attached to the rollers. Furthermore, even though dusts are attached to the rollers, they can be easily removed. As a result, a development process can be carried out with less contamination of a film. Therefore, the invention can be widely applied to such fields as a mask film.

The present disclosure relates to the subject matter contained in Japanese Patent Application No. 12754B/2004 filed on Apr. 23, 2004, which is expressly incorporated herein by reference in its entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. An automatic developing apparatus for processing a photographic light-sensitive material having a support having a thickness of from 160 to 225 μm, the automatic developing apparatus comprising a developing part, a fixing part and a rinsing rack part, the developing part, the fixing part and the rinsing rack part each having a roller for conveying the light-sensitive material, and at least one of the rollers of the developing part, the fixing part and the rinsing rack part having a surface mainly comprising a nonpolar polymer substance and having a center line surface roughness (Ra) of 20 μm or less.

2. The automatic developing apparatus as claimed in claim 1, wherein at least one of the rollers of the rinsing rack part has a surface mainly comprising a nonpolar polymer substance and having a center line surface roughness (Ra) of 20 μm or less.

3. The automatic developing apparatus as claimed in claim 1, wherein all the rollers of the developing part, the fixing part and the rinsing rack part have a surface mainly comprising a nonpolar polymer substance and having a center line surface roughness (Ra) of 20 μm or less.

4. The automatic developing apparatus as claimed in claim 1, wherein the roller having a surface mainly comprising a nonpolar polymer substance and having a center line surface roughness (Ra) of 20 μm or less has no groove for conveying.

5. The automatic developing apparatus as claimed in claim 1, wherein the nonpolar polymer substance is a fluorine resin, a polyethylene resin, a polypropylene resin, a vinylidene fluoride resin or a polycarbonate resin.

6. The automatic developing apparatus as claimed in claim 1, wherein the nonpolar polymer substance is a tetrafluoroethylene resin.

7. A process for forming an image comprising a step of processing a photographic light-sensitive material having a support having a thickness of from 160 to 225 μm with an automatic developing apparatus comprising a developing part, a fixing part and a rinsing rack part each having a roller for conveying the light-sensitive material, and at least one of the rollers of the developing part, the fixing part and the rinsing rack part having a surface mainly comprising a nonpolar polymer substance and having a center line surface roughness (Ra) of 20 μm or less.

8. The process for forming an image as claimed in claim 7, wherein the photographic light-sensitive material has an emulsion surface containing a matte material having an average particle diameter of 10 μm or less.

9. The process for forming an image as claimed in claim 7, wherein the photographic light-sensitive material has no gelatin layer on a surface opposite to an emulsion surface.

10. The process for forming an image as claimed in claim 7, wherein the photographic light-sensitive material has a gradation sequence of 10 or more.

* * * * *